US005931740A

United States Patent [19]

Kitchen

[11] Patent Number: 5,931,740

[45] Date of Patent: Aug. 3, 1999

[54] MODULE-TYPE AMUSEMENT RIDE

[76] Inventor: William Joel Kitchen, 10385 Sailor Ct., Longmont, Colo. 80501

[21] Appl. No.: 08/892,823

[22] Filed: Jul. 15, 1997

[51] Int. Cl.[6] ..... A63G 9/12

[52] U.S. Cl. ..... 472/118; 472/133

[58] Field of Search ..... 472/118, 119, 472/125, 130, 137, 133, 131

[56] References Cited

U.S. PATENT DOCUMENTS

| | | | |
|---|---|---|---|
| 857,338 | 6/1907 | Fitch . | |
| 1,731,532 | 10/1929 | Hoppes . | |
| 1,918,559 | 7/1933 | Pruessner . | |
| 2,779,596 | 1/1957 | Ridgway | 272/56.5 |
| 3,140,870 | 7/1964 | Walker | 272/85 |
| 3,701,528 | 10/1972 | Ryan | 272/6 |
| 4,978,120 | 12/1990 | Greenwood | 272/85 |
| 5,267,906 | 12/1993 | Kitchen | 472/118 |
| 5,527,223 | 6/1996 | Kitchen | 472/118 |
| 5,649,866 | 7/1997 | Balwanz | 472/118 |
| 5,665,002 | 9/1997 | Balwanz | 472/118 |

FOREIGN PATENT DOCUMENTS 362475 of 1961 Japan .

*Primary Examiner*—Kien T. Nguyen

*Attorney, Agent, or Firm*—Patent Law Offices of Rick Martin, P.C.

[57] ABSTRACT

The ride (100) is capable of raising a rider module (20) to a height of ten meters or more above the ground, and then releasing the rider module (20) to swing. The ride (100) includes an arch (10) having two upper support brackets (11, 19), a support line (13) secured to the support structure at one end, with an opposed end secured to chair assembly (20). A launch tower (15) is spaced from the arch (10) and carries a launch line (14) which has an end which is capable of being raised and lowered above the ground by a winch. In operation, the support line attached is secured to the rider module. The launch line is releasably secured to the rider module, and the launch line is activated to move the rider module laterally and upwardly towards the top of the launch tower. When the launch line is released from the rider module it swings downwardly at a high speed simulating the sensation of "body flight" in a pendulum like motion. Optionally, the rider module spins while in flight. The rider module may comprise a chair assembly, rider harness, or a rider sling. Alternately, the launch tower may be attached to the upper support structure to reduce the footprint of the ride.

15 Claims, 6 Drawing Sheets

MODULE-TYPE AMUSEMENT RIDE

FIELD OF INVENTION

This invention is a module-type amusement ride which is an improvement to a swing-type amusement ride. The module-type amusement ride comprises a support structure, a launch structure, and a mechanism capable of raising a rider module or a plurality of rider modules to a position at least ten meters above the ground, from which position the rider module swings away from the launch structure in a curved trajectory under the support structure. In one embodiment, the rider module may rotate or pivot about a vertical axis as it swings. A multi-rider embodiment can carry several rider modules simultaneously.

BACKGROUND OF THE INVENTION

Heretofore, there have been a variety of different types of amusement rides and apparatus for simulating the reduction of gravity to a rider. Some of these devices are known to be disclosed in Fitch, U.S. Pat. No. 857,338; Ridgway, U.S. Pat. No. 2,779,596; Ryan, U.S. Pat. No. 3,701,528; Greenwood, U.S. Pat. No. 4,978,120; Kitchen et al., U.S. Pat. No. 5,267,906; and Kitchen et al., U.S. Pat. No. 5,527,223.

Furthermore, there have been a variety of playground and backyard swings and swing sets used by children and adults. These swings can vary in height from a small swing standing about three meters high, to a large swing standing about five meters high. A rider of such a swing normally takes a sitting position in a swing seat and starts its pendulum motion from a position in which the swing is vertical, unless aided by a running start, or by a person to help push and enhance the height of the swing arc. While the sitting or standing position on a swing seat is the norm, riders have been known to lie on their stomachs on top of a swing seat and swing in a prone position, but without being secured to the swing.

Even the most skillful and powerful swing rider on a large swing will rarely exceed a 2 o'clock or 10 o'clock position at a height of about seven meters, before gravity overtakes the centrifugal force of the swing, and slack occurs in the swing rope or chain. Should a rider manage to force the swing to make a 360° degree circuit, his or her height would seldom exceed about ten meters from the ground.

The use of external equipment to assist a swing rider to begin his or her ride from an elevated position is taught in Hoppes U.S. Pat. No. 1,731,532; Pruessner U.S. Pat. No. 1,918,559; and Walker U.S. Pat. No. 3,140,870. Each of these references discloses standard playground and backyard type swing systems which have adjacent stairs a person climbs to start swinging from a position above the ground. The rider thereby obtains an immediate swing elevation and experiences an initial speed which is higher and faster than starting to swing from the ground. But, even in these systems the initial height above the ground which the rider experiences would seldom be more than about one to four meters.

The closest known prior art is described in Japanese patent no. 36-2475 dated Apr. 1, 1961, to Nogima. This describes a chair-type swing having a cradle which is pulled to a launch position by a sliding car on rails. However, this device is clumsy in operation and its construction restricts the release height of the chair. Further, the cradle does not spin during operation.

In some swing systems, and especially those designed for small children, and in some amusement rides, bungee jumping equipment, parachute equipment, hang gliding systems, and the like, mechanisms for securing a rider to the equipment is provided. But, none of these systems provide a ride which initiates a rider module release at a height of more than ten meters above the ground. The prior art swing sets have not been large enough, strong enough or high enough to justify the use of a module for riders. Furthermore, prior art swing technology has not been known to operate at heights which allow a rider to reach a height which is greater than about seven to ten meters above the ground, or, other than in a trapeze system, to swing from a "launch" structure towards a "support" structure. It is noted that in trapeze systems, the swings are intentionally "high above the center ring", and never approach the ground.

Kitchen '906 and Kitchen '223 disclose an amusement ride and swing-type amusement ride which comprise a support structure, a support line, and a launch structure. However, Kitchen '906 support the rider(s) in a harness or an equivalent which causes the rider(s) to operate in the prone position. Some persons cannot handle this prone position for a variety of reasons including fear and physical incapacity. Older or physically challenged riders sometimes cannot handle strapping into a harness in a prone position.

Thus, nowhere in the prior art is there a module-type amusement ride which includes, in combination, a support structure having an upper portion which is located ten meters (and as much as several hundred meters or more) above the surface of the ground, a support line having an upper end connected to the upper portion of the support structure and a lower end to which is connected a system for securing a rider module to the support line or a plurality of rider modules to a support structure. In Kitchen '223 a multi-rider embodiment referred to as the Skysaucer can accommodate up to 120 riders in a saucer suspended from a support structure. However, the Kitchen '223 riders are seated in a plurality of rows, and the Skysaucer does not rotate about the axis of the support lines. The instant invention discloses alternate embodiments of a rider module which are nonobvious in light of the prior art. The present invention fills the market niche of offering virtually all riders the thrill of feeling true body-flight experience riding either alone or in small groups.

Further included is a launch structure which has an upper portion which is located ten meters (and as much as several hundred meters more) or more above the surface of the ground. The launch structure is spaced from the upper portion of the support structure, and which carries a launch line which includes a launching mechanism for releasable attachment to each rider module. In an alternate embodiment, the launch tower is attached to the top of the upper support structure thereby reducing the ground "footprint" of the ride. Also included is a mechanism associated with the launch structure, but which is not powered by the rider, for raising the rider module or modules which has been secured to the system to a height of at least ten meters (and as much as several hundred meters or more) above the ground, from which height the rider module or modules swing away from the launch structure towards the ground at high speed in a curved trajectory. Further novelty is taught by a multi-rider embodiment which can carry several rider modules simultaneously.

SUMMARY OF THE INVENTION

It is, therefore, an aspect of the present invention to provide a rider of the subject amusement ride with a sensation of "body flight".

Another aspect of the present invention is to provide the thrills and excitement of bungee jumping, but without the dangers related to the use of rubber or elastic cords, without the possibility of failing to make harness connections to the support line, and without subjecting the body of the rider to the type of stress borne by a bungee jumper, and without the natural fear of a "free fall" plunge associated with bungee jumping.

Yet another aspect of the present invention is to provide an amusement ride which can be enjoyed by a single rider secured in a single rider module, or by a plurality of riders who may enjoy the thrill of riding together while secured in a multi-rider module.

Yet another aspect of the present invention is to provide an amusement ride which can include a plurality of rider modules to afford simultaneous rides to numerous riders.

Another important aspect of the present invention is to provide a body flight experience for the physically-challenged rider.

Yet a further aspect of the present invention is to furnish an amusement ride which provides smooth, fast acceleration, excitement and thrills, while being a fail safe ride, without the anxiety and trauma related to finding the nerve to jump from an elevated platform in a "free fall" plunge, such as that which is associated with bungee jumping and sky diving.

Another aspect of the present invention is to provide a high altitude amusement ride which has a low injury potential for its operators by allowing the operators of the ride to remain on the ground, as opposed to having to work aloft at high altitudes and at risk, as with bungee jumping and sky diving operations.

Another aspect of the present invention is to provide an amusement ride in which the rider swings back and forth in a pendulum-like motion about a dozen times or more before terminating the ride.

Another aspect of the multi-rider embodiment is to provide a means for safely allowing many riders to enjoy the ride together, thus providing a more secure feeling to each rider than the single rider embodiment.

Another aspect of the multi-rider embodiment is to provide a faster and more elevated ride than the single rider embodiment.

Another aspect of the multi-rider embodiment is to allow more riders to be serviced in a given time than the single rider embodiment, thereby providing greater revenue to the operator.

Yet another aspect of the present invention is to provide an amusement ride having the launch tower attached to the support structure thereby reducing the footprint of the ride.

Other aspects of this invention will appear from the following description and appended claims, reference being had to the accompanying drawings forming a part of this specification wherein like reference characters designate corresponding parts in the several views.

The present invention provides a module-type amusement ride for raising one or more riders in a rider module and/or one or more rider modules from a position at or near a support surface aloft to a height of ten meters or more. The rider module is released to swing in a curved trajectory for thrill and excitement, but with little or no stress placed on the body of the rider(s). The amusement ride includes a support structure extending upwardly at least eleven meters above the ground (and as much as several hundred meters or more). The support structure may be a static tower, a static derrick, a static arch, a bridge, other static man-made structures, a crane, naturally occurring geological formations, and the like.

One end of a rider module support line is secured to the upper portion of the support structure at a point which is at least eleven meters from the ground, while the second end of the rider module support line is secured to a rider module securing attachment, to which a rider module can be secured during the ride. The rider module may comprise a seat or a sling which puts a rider in a seated position. A plurality of rider modules may be attached to a support structure in this manner. In preferred embodiments, one end of a second line, which is used as a stabilization line, is also secured to the upper portion of the support structure, while the second end of the stabilization line is also secured to the attachment which secures the rider module during the ride.

The rider module may comprise a chair assembly or a harness or a sling. The chair assembly comprises a plurality of chairs in a frame with rider restraints and a retaining bar similar to a ski-lift chair. The harness assembly is as described in U.S. Pat. No. 5,527,223 to Kitchen, FIGS. 6 and 7 (column 9, lines 37 to column 10, line 13 and column 11, lines 14 through 33), incorporated herein by reference. The sling is related to the harness but contains the non-obvious improvement of supporting the rider in a seated position. This is accomplished by attaching the sling to the stabilization line and support line at a point center-front on the rider. Each rider module embodiment may be interchanged with each of the others for the purposes of ride operation.

Disposed near the support structure is an upright launch structure having an upper portion which is spaced from the upper portion of the support structure. The launch structure may also be a static tower, a static derrick, a static arch, a bridge, other static man-made structures, a crane, naturally occurring geological formations, man made geological formations, and the like, which have an upper portion which has a height which reaches or exceeds at least eleven meters from the ground (and as much as several hundred meters or more). A plurality of launch towers may be used to accommodate the embodiment having a plurality of rider modules. Further, the launch tower may be attached to the top of the support structure to reduce the size of the footprint of the ride.

The upper portion of the launch structure carries a launch line which has a free end which is capable of being lowered and of being raised to a height which reaches or exceeds at least ten meters above the ground. In the plurality of rider modules embodiment, each rider module has its own launch line. One end of the launch line is designed to be releasably attached to the swivel on the rider module. As detailed below, the launch line is capable of raising a rider module which is releasably secured to an attachment to a height of at least eleven meters above the ground. The launch line is attached to the release device, preferably a quick release device. The release device is optionally mounted to a swivel located between the attachment device which carries the rider and the launch line. This embodiment allows the rider in the rider module to release the launch line and begin the swing descent at will. The swivel embodiment allows the rider module to spin about an axis roughly parallel to the support line.

In operation, the riders are initially in an upright standing position on the ground, or on a stand closely adjacent to the ground beneath the support structure. The ride ground crew places each rider in the rider module or harness or sling each of which is supported by the support line. The ground crew next attaches the launch line which depends from the launch structure to the release mechanism or device mounted on the rider module.

The ride operators then activate the launch line to retract the rider module towards the launch structure at a controlled speed. This causes the rider module to be moved laterally from beneath the rider module and towards the launch structure. If the rider module is properly connected to the support and/or stabilization lines, then at this time the rider module will be raised aloft from the ground. The rider module will be suspended from the support structure by the support and/or stabilization lines and from the launch structure by the launch line. As a fail safe measure, if the rider module is not properly connected to the support and/or stabilization lines, then at this time, the rider module will be pulled laterally. It will not be immediately raised aloft from the ground, and the operation can be terminated. As the launch line continues to be retracted towards the launch structure at a controlled speed, the rider module with rider(s) is raised in a curved path further and further from the ground, towards the launch structure and away from the support structure.

When the rider module reaches a predetermined height, preferably eleven meters or more above the ground, or when the rider activates the release, the launch line is disconnected from the rider module. Then the rider module with riders begins to fall in a curved trajectory which simulates the sensation of being in flight. The resulting sensation, including acceleration to speeds from about seventy to more than eighty kilometers per hour, is similar to hang-gliding and skydiving, including the surge of the wind and the excitement of "ground rush" while approaching and passing close over the ground and objects projecting from the ground at high speeds. The rider module then continues to swing back and forth in a curved trajectory underneath the support structure until it slows to a speed at which the ride operators may stop and remove the rider(s) from the rider module.

In preferred embodiments, the support line is made of an aircraft-quality stainless-steel cable with safety in mind. Most importantly, the ride does not depend on the use of rubber and elastic bungee cords. As used herein, the "ground" may be an actual ground surface, or a man made surface such as pavement, tarmac, or a concrete pad and the like. The height of the structures or of the rider module from the ground may be measured with respect to the actual "ground", or to a depression below the structures, such as a river bed, ravine, valley, or the like. As used herein, the portion of the support structure to which the support line is attached, and the portion of the launch structure from which the launch line is attached will always be considered to be the "upper portion" of the structure.

In an alternative mode of operation, the rider module may be lifted directly to the top of the launch structure, and the support line and stabilization line secured to the rider module or other attachment. Then, the rider may launch him or herself from the launch structure in the rider module and experience a ride which is similar to that of the preferred embodiment. In such an operation, the support line and stabilization line will be raised to the top of the launch structure by the launch line. This alternative mode of operation will allow the support and stabilization lines to have a substantial amount of slack, thus making the initial part of the ride vertical rather than curved. By proper calculation of height and elasticity, the use of bungee support and stabilization lines would add further vertical drop to the ride. An elevator may be used to carry the riders to the top of the launch structure.

In an alternative mode of operation, several riders are fastened in a multi-rider rider module. Up to four parallel support lines approximately 100 meters long may be used to secure the rider module to a support structure. The rider module is lifted with a launch line approximately 100 meters to a launch structure. The multi-rider rider module is then released in much the same way as the single-rider rider module embodiment. In preferred embodiments, a second set of up to four parallel lines are used for stabilization. The stabilization lines are arranged in a criss-cross fashion to prevent twisting and sway.

Alternatively, two support lines, or just a single support line could be used. It is preferred to use at least as many stabilization lines as support lines since the stabilization lines function also as backup safety lines for the unlikely event of support line failure.

In yet another embodiment, a plurality of rider modules may be supported from a single support structure. Each rider module is then operated from its respective launch tower and a launch line.

These and other aspects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
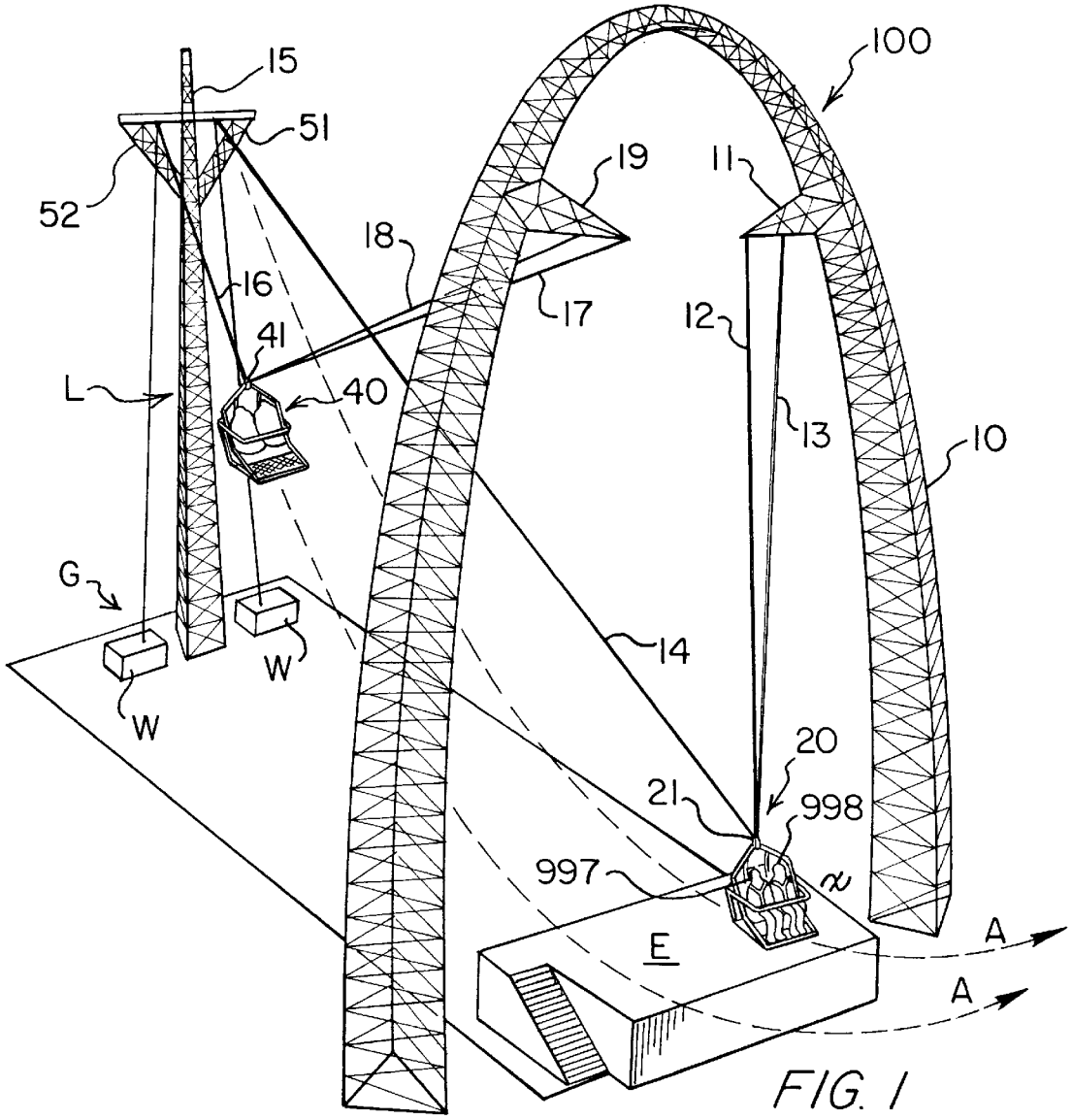
FIG. 1 is a diagrammatic perspective view of the preferred embodiment illustrating the subject invention using a fixed tower (an arch) as a support structure with two chair assemblies suspended from a support line and stabilization line, and connected to a launch line.

Referring to FIG. 1 the general arrangement of the preferred embodiment of the module-type amusement ride is depicted. The amusement ride 100 comprises an arch 10. Attached to the upper portion of the arch 10 are upper support brackets 11 and 19. The upper end of support line 13 and stabilization line 12 attach to the upper support bracket 11. The lower end of support line 13 and stabilization line 12 are attached to the rider module 20 at pivot point 21. The upper end of support line 18 and stabilization line 17 attach to upper support bracket 19. The lower end of support line 18 and stabilization line 17 are attached to rider module 40 at pivot point 41. Attached to rider module 40 at pivot point 41 is launch line 16. Launch line 16 is routed back to and through launch tower bracket 51 to ground "G" where it attaches to winch "W". Also attached to rider module 20 at pivot point 21 is launch line 14. Launch line 14 is routed back to and through launch tower bracket 52 to the ground "G".

In operation, the riders embark rider module 20 while it is in position "X". The riders may embark from an elevated platform "E" or from the ground "G". Launch line 16 pulls rider module 40 to launch position "L" via a motive force such as winch "W". Launch line 14 then pulls the rider module 20 to the launch position "L" via a motive force such as winch "W". Launch line 14 is then released either by the riders or by an operator (not shown) from pivot point 21 which allows rider module 20 to swing through arc "A".

Figure 2:
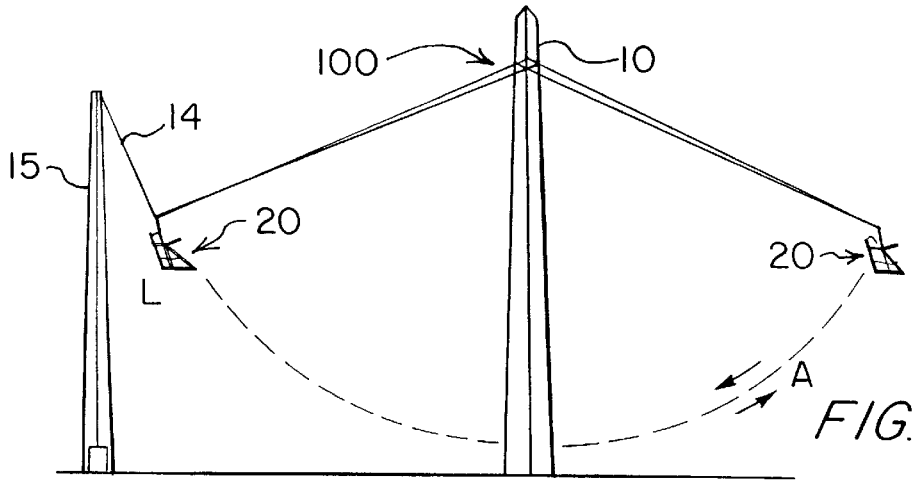
FIG. 2 is a side view of the trajectory of the rider module of FIG. 1 in motion.

FIG. 2 is a side view of the ride in operation with the rider module 20 in oscillation. The view shows arc "A", the line of travel of rider module 20 after release. Position "B" shown in dots shows the rider module 20 at launch position "L".

Figure 3:
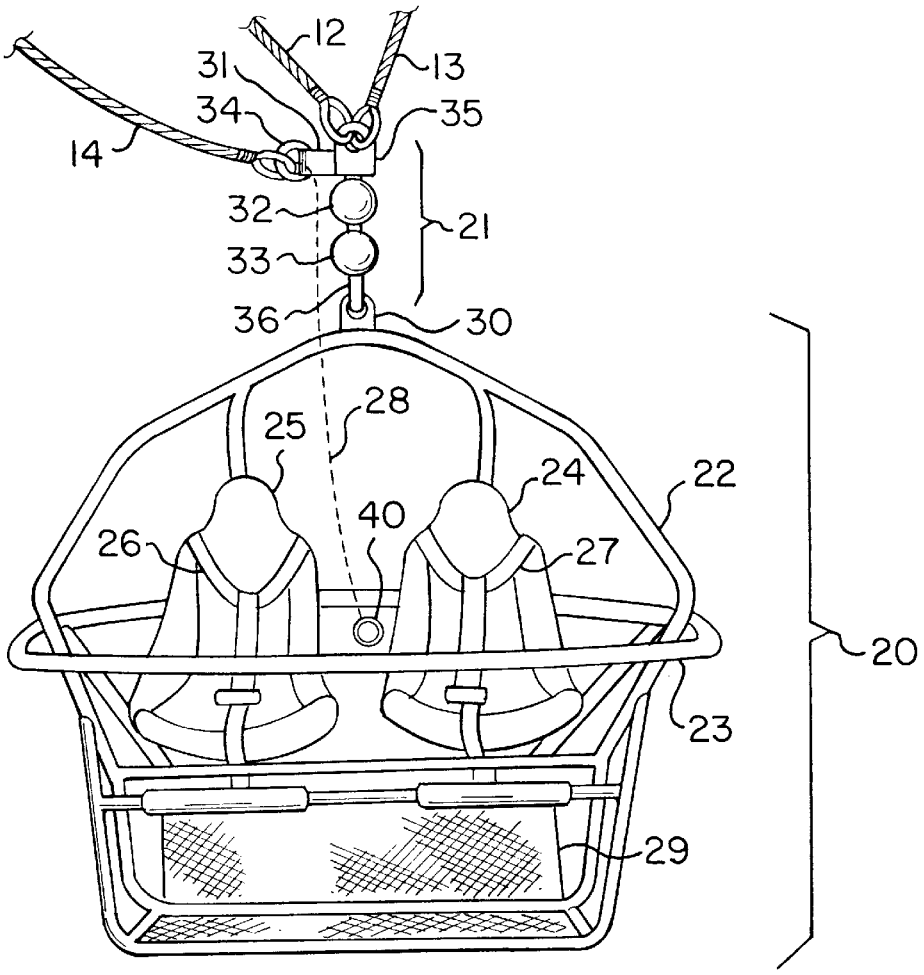
FIG. 3 is an enlarged front plan view of the support and stabilization line of the preferred embodiment shown in FIG. 1.

FIG. 3 is a detail of the two-rider rider module 20. Rider module 20 is attached to attachment mechanism 21 at eye 30. Attachment mechanism 21 is attached in turn to the lower end of stabilization line 12 and the lower end of support line 13. Attachment mechanism 21 is also attached to launch line 14 by release mechanism 34. Release mechanism 34 is attached to eye 35 by eye 31. Release mechanism 34 is known in the art of sky diving as a three-ring release mechanism. Other known release mechanisms are released in a known manner by a release switch (not shown) located in the rider module or on the ground. Rider module 20 comprises seats 24 and 25 secured to frame 22. Each rider is restrained in each seat by seat belts 26, 27, respectively. Kick plate 29 provides a firm surface to stand on while loading and unloading as well as providing protection for the riders' feet. Attachment mechanism 21 also may comprise a swivel 32, 33, thereby enabling rider module 20 to rotate through 360° on an axis roughly parallel to support line 13 while swinging. Swivel 32, 33 rotatably attaches to eye 35. The lower end of stabilization line 12 and support line 13 attach to eye 35. Launch line 14 is releasably attached to eye 31 through release mechanism 34. Release mechanism 34 is operated by a rider (not shown) by pulling on release ring 40 which is attached to release line 28. In operation, the rider or operator pulls on release ring 40 which causes release mechanism to disconnect eye 31 from launch line 14.

Figure 4:
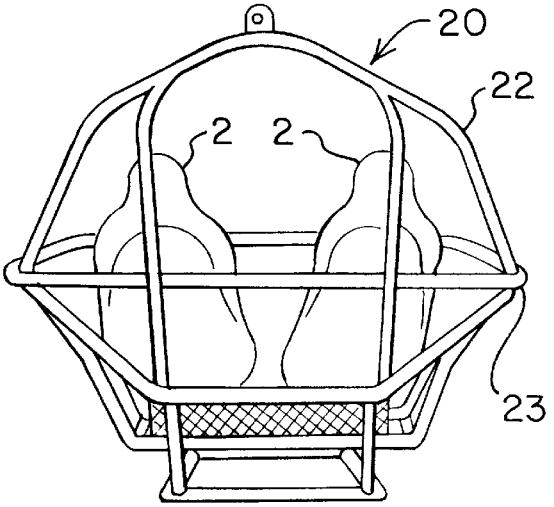
FIG. 4 is a rear plan view of the two-rider rider module shown in FIG. 3.
Figure 5:
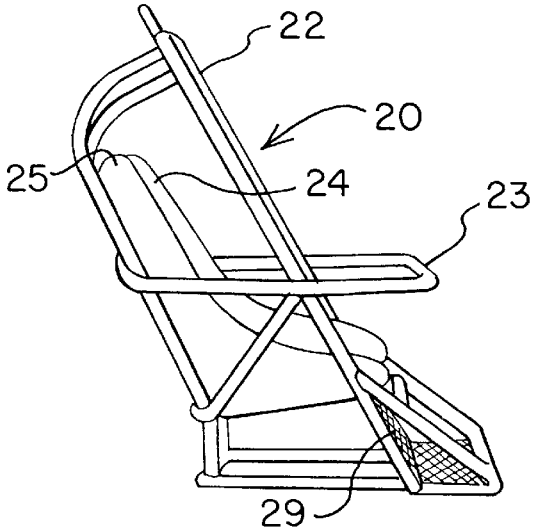
FIG. 5 is a side perspective view of the rider module shown in FIG. 4.

FIGS. 4, 5 are a rear view and side view respectively of the rider module 20. In an alternate embodiment (not shown) a plurality of riders, up to four may be accommodated by a multi-rider module assembly as shown in FIG. 6.

Figure 6:
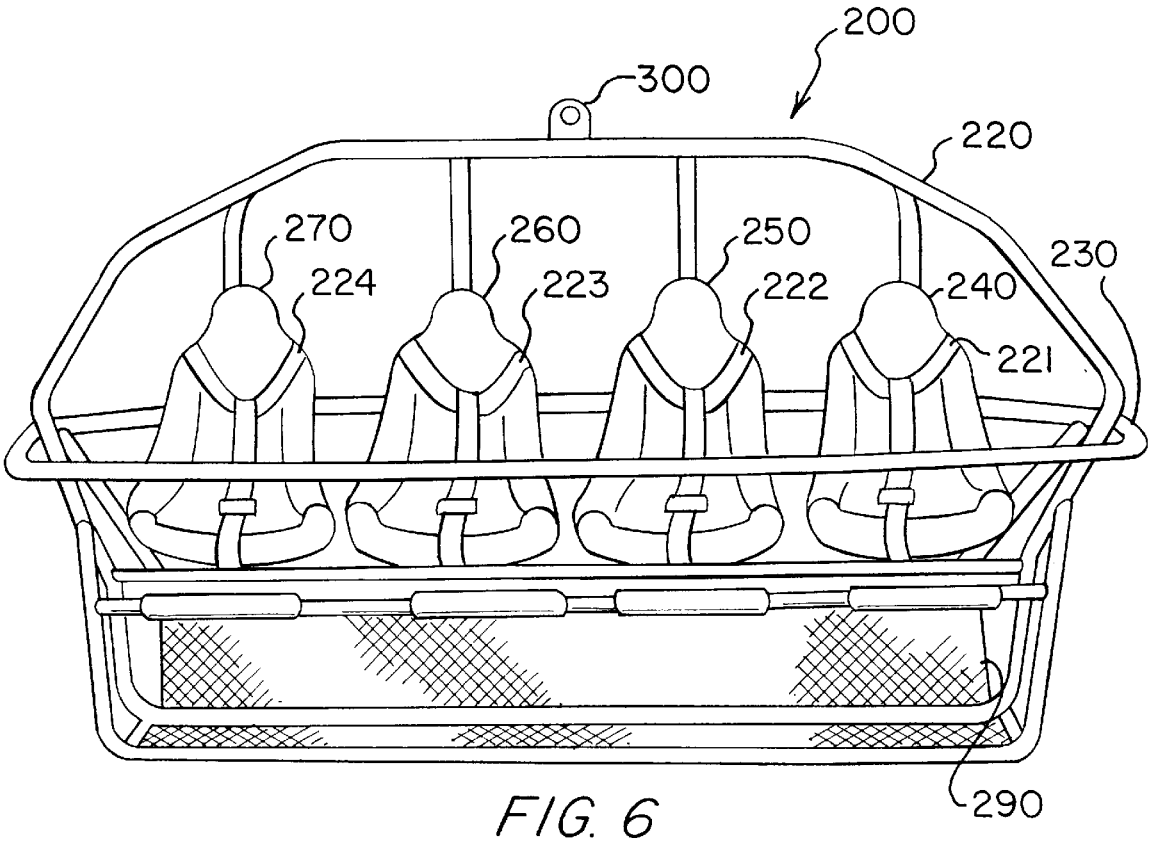
FIG. 6 is a front plan view of a four-rider rider module embodiment.

FIG. 6 is a front plan view of an alternate embodiment depicting a four-rider arrangement of rider module 200. Seats 270, 260, 250, and 240 are attached to frame 220. Each seat has restraints 224, 223, 222, 221 respectively, for retaining a rider in his/her seat. Rider module 200 is attached to the attachment mechanism 21 at eye 300 in the manner described for rider module 20 in FIG. 3. Frame 220 also comprises retaining bar 230 which provides a place for riders to grip while affording the safety of an additional means of retaining a rider in the unlikely event of failure of a restraint. Kick plate 290 mounted on frame 220 at foot level of the riders provides a firm surface to stand on while loading and unloading as well as providing for protection of the riders' feet. In operation, retaining bar 230 swings up above the heads of the riders for loading and unloading. It closes to the position shown for operation of the ride.

Figure 7:
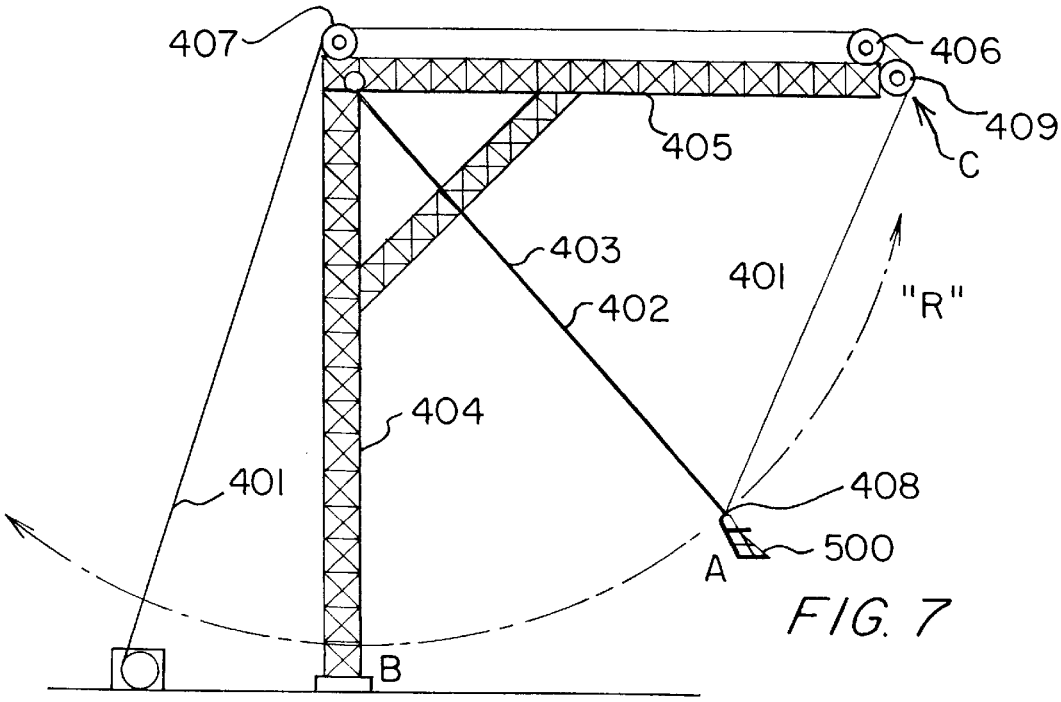
FIG. 7 is a side view of an alternate embodiment with the launch tower attached to the support tower.
Figure 8:
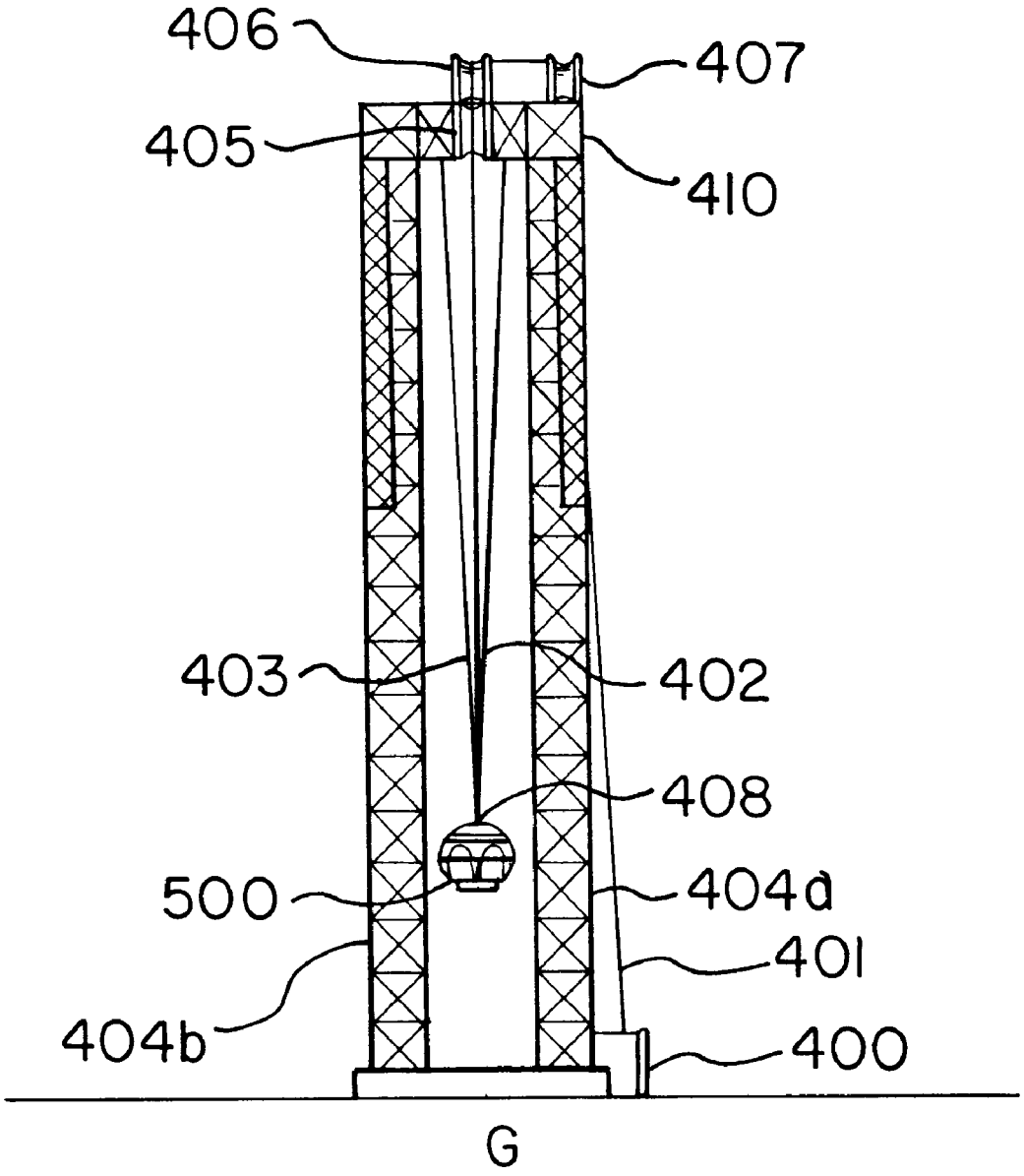
FIG. 8 is a front view of the alternate embodiment shown in FIG. 7.

FIGS. 7, 8 depict a side plan view of an alternate embodiment of the invention. In this alternate embodiment the launch tower as described in FIG. 1 is attached to the upper support structure instead of being attached to the ground. Tower 404 supports launch tower 405 from the top of tower 404. Pulley 407, pulley 406, and pulley 409 are located at each end of launch tower 405. Rider module 500 is supported from tower 404 by support line 402 and stabilization line 403. Launch line 401 is routed from winch 400 over pulley 407, over pulley 406, and pulley 409 to release mechanism 408. Launch tower 405 is disposed from tower 404 at angle "A" such that the rider module 500 when raised and released moves in a curved trajectory "R". In operation, the riders board rider module 500 while it is hanging vertically at location "B". Once boarding is complete, launch line 401 is retracted by winch 400 until rider module 500 is at release point "C". Rider module 500 is then released by the operator or rider by operation of release mechanism 400. Rider module 500 then swings freely through arc "R".

FIG. 8 depicts a front plan view of the alternate embodiment shown in FIG. 7. Tower 404 is comprised of leg 404*a* and leg 404*b*. Cross-member 410 supports support line 402 and stabilization line 403. Pulley 407 is slightly offset axially from pulley 406 and pulley 409 to provide for the path of rider module 500 through the legs of tower 404.

Figure 9:
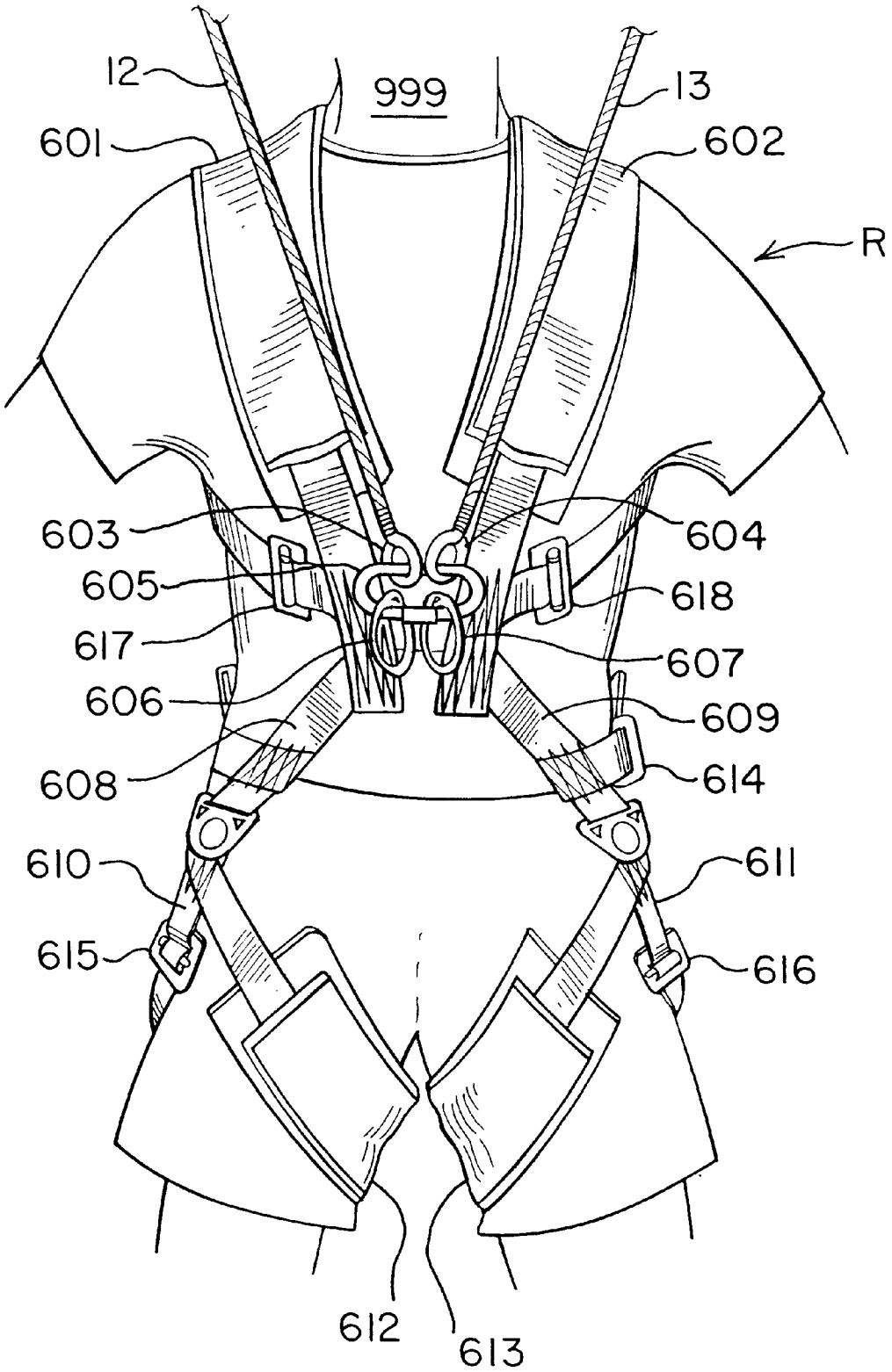
FIG. 9 is a front plan view of an alternate embodiment of a rider module.

FIG. 9 depicts a front view of an alternate embodiment of a rider module. Stabilization line 12 and support line 13 attach to carabener 605. The rider sling 600 supports a single rider from the support line 13 and stabilization line 12 at carabener 605. Eyelets 603, 604 provide the means to attach stabilization line 12 and support line 13 to carabener 605. Sling 600 comprises shoulder straps 601, 602. These loop from the front of the rider 999 around the rider's back, over the rider's shoulders and to the front of the rider. Thigh straps 608, 609 loop from the front of the rider 999, around the rider's thighs and to the front of the rider. Pads 612 and 613 provide comfort for a rider. The carabener 605 attaches to the sling webbing at loops 606 and 607. Shoulder straps 601 and 602 are adjustable at adjustments 617 and 618 respectively. Thigh straps 610 and 611 are adjustable at adjustments 615 and 616 respectively.

Figure 10:
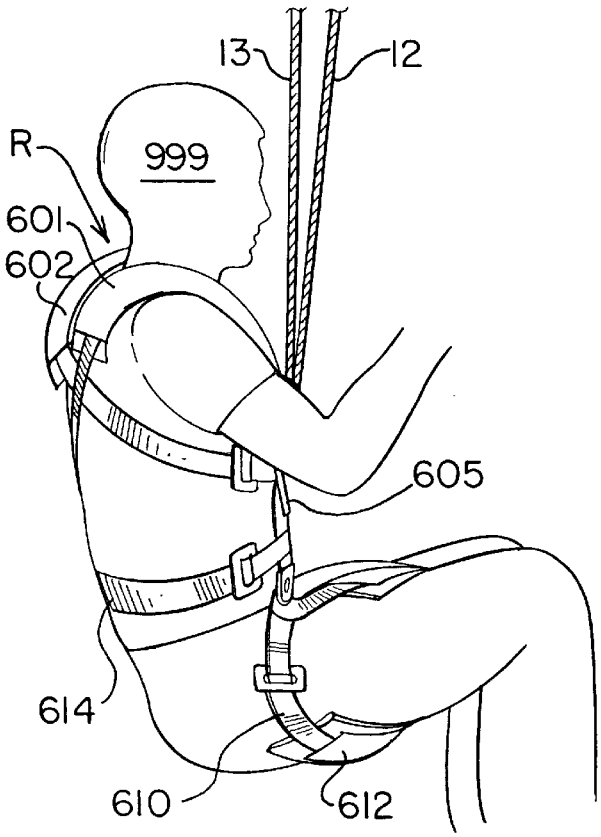
FIG. 10 is a side perspective view of the rider sling embodiment shown in FIG. 9 with the rider suspended in air.

FIG. 10 depicts a side view of the rider sling. Rider 999 assumes a seated position when the ride is in operation. In operation, Rider 999 is strapped into thigh straps 610, 611 and shoulder straps 601, 602. Waist strap 614 is attached around the rider's waist. Once in the rider module "R", rider 999 then is attached to stabilization line 12 and support line 13 with carabener 605.

Figure 11:
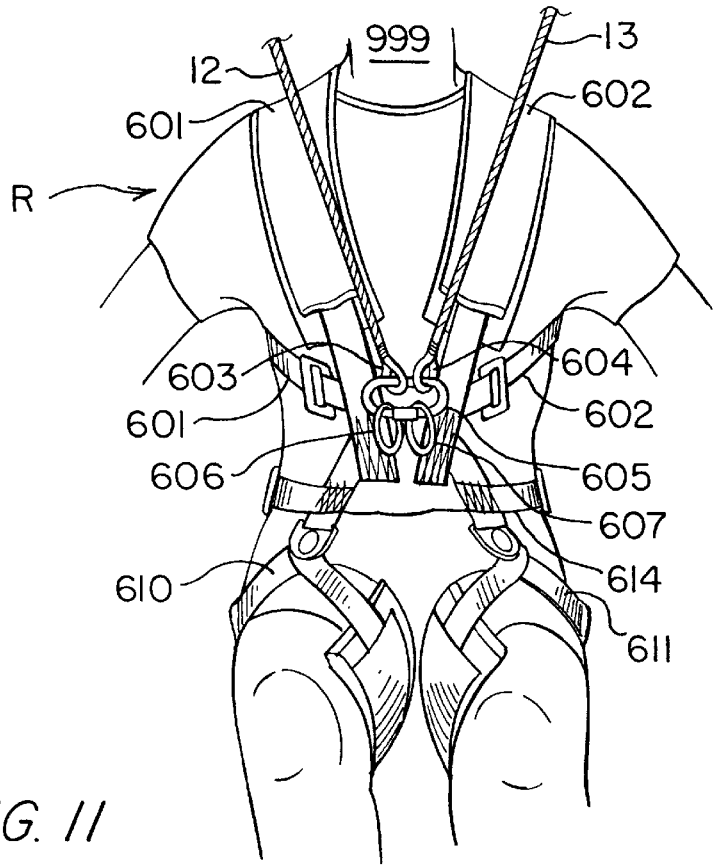
FIG. 11 is a front plan view of the rider sling embodiment shown in FIG. 10.

FIG. 11 depicts a front view of the rider module "R". Rider 999 is shown in the seated position. This is a result of the rider's weight bearing on the stabilization line 12 and support line 13 through carabener 605. It is from this position that the rider 999 is launched. Not shown is a plurality of rider modules "R" affixed from a horizontal support bar. Each rider module "R" is an equivalent to a conventional bungee jumping harness.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An amusement ride for raising a rider module from a static position at or near the ground to a height of at least ten meters and releasing the rider module to swing in a curved trajectory, the amusement ride comprising:

a support structure extending at least eleven meters from the ground;

said support structure having an upper support structure suspending a support line and a stabilization line, each line having a lower end;

said lower ends attached to a rider module;

said support structure having a launch tower extending upwardly from said upper support structure and disposed from said support structure at an angle adequate to raise the rider module at least ten meters above the ground by a launch line routed through the launch tower and fastened to a winch; and said launch line having a release mechanism comprising a swivel allowing said rider module to rotate through 360° attached to the rider module, whereby the rider module is raised at least ten meters above the ground by the winch, and the release mechanism is opened to allow the rider module to swing in a curved trajectory.

2. The amusement ride as claimed in claim 1 further comprising:

a plurality of support lines attached to said upper support structure;

a plurality of stabilization lines attached to said upper support structure; and a plurality of rider modules each attached to the lower end of a stabilization line and the lower end of a support line.

3. The amusement ride as claimed in claim 2 further comprising:

a plurality of launch brackets each having a launch line attached to the release mechanism, whereby a plurality of rider modules is raised at least ten meters above the ground by a plurality of winches.

4. The amusement ride as claimed in claim 1, wherein said rider module further comprises an upright seat.

5. The amusement ride as claimed in claim 1, wherein said rider module further comprises a rider sling.

6. The amusement ride as claimed in claim 5, wherein said rider sling further comprises:

a thigh strap releasably wrapped about a rider's thigh;

a shoulder strap releasably wrapped about a rider's shoulder;

a waist strap releasably wrapped about a rider's waist;

said thigh strap and said shoulder strap and said waist strap connected about a rider at a releasable connection; and a releasable connector connected to said releasable connection, whereby a rider is releasably attached to said support line.

7. The amusement ride as claimed in claim 1, wherein said rider module further comprises a rider harness.

8. An amusement ride for raising a rider from a static position at or near the ground to a height of at least ten meters and releasing the rider to swing in a curved trajectory, the amusement ride comprising:

a support structure extending at least eleven meters from the ground;

said support structure having an upper support structure suspending a support line and a stabilization line, each line having a lower end;

said lower ends attached to a rider harness;

said support structure having a launch tower extending upwardly from said upper support structure and disposed from said support structure at an angle adequate to raise the rider harness at least ten meters above the ground by a launch line routed through the launch tower and fastened to a winch; and said launch line having a release mechanism comprising a swivel allowing said rider to rotate through 360° attached to the rider, whereby the rider is raised at least ten meters above the ground by the winch, and the release mechanism is opened to allow the rider to swing in a curved trajectory.

9. The amusement ride as claimed in claim 8 further comprising:

a plurality of support lines attached to said upper support structure;

a plurality of stabilization lines attached to said upper support structure; and a rider harness attached to the lower end of a stabilization line and the lower end of a support line.

10. The amusement ride as claimed in claim 8 further comprising:

a plurality of support lines attached to said upper support structure;

a plurality of stabilization lines attached to said upper support structure; and a rider sling attached to the lower end of a stabilization line and the lower end of a support line.

11. The amusement ride as claimed in claim 8 further comprising:

a plurality of support lines attached to said upper support structure;

a plurality of stabilization lines attached to said upper support structure; and a chair assembly attached to the lower end of a stabilization line and the lower end of a support line.

12. An amusement ride for raising a chair assembly from a static position at or near the ground to a height of at least ten meters and releasing the chair assembly to swing in a curved trajectory, the amusement ride comprising:

a support structure extending at least eleven meters from the ground;

said support structure having an upper support structure suspending a support line and a stabilization line, each line having a lower end;

said lower ends attached to a chair assembly having an upright seat affixed to a frame;

said frame having a maximum load capacity of four riders;

a launch tower extending upwardly from the ground and disposed from said support structure at a distance adequate to raise the chair assembly at least ten meters above the ground by a launch line routed through the launch tower and fastened to a winch; and said launch line having a release mechanism attached to the chair assembly, whereby the chair assembly is raised at least ten meters above the ground by the winch, and the release mechanism is opened to allow the chair assembly to swing in a curved trajectory;

wherein said upright seat further comprises a rider restraint;

wherein said frame further comprises a movable retaining bar mounted across said chair whereby a rider is restrained in said chair; and wherein said release mechanism further comprises a swivel allowing said chair assembly to rotate through 360°.

13. An amusement ride for raising a chair assembly from a static position at or near the ground to a height of at least ten meters and releasing the chair assembly to swing in a curved trajectory, the amusement ride comprising:

a support structure extending at least eleven meters from the ground;

said support structure having an upper support structure suspending a support line and a stabilization line, each line having a lower end;

said lower ends attached to a chair assembly having an upright seat affixed to a frame; said chair assembly further comprises a plurality of chairs attached to the frame;

said frame having a maximum load capacity of four riders;

a launch tower extending upwardly from the ground and disposed from said support structure at a distance adequate to raise the chair assembly at least ten meters above the ground by a launch line routed through the launch tower and fastened to a winch;

said launch line having a release mechanism attached to the chair assembly, whereby the chair assembly is raised at least ten meters above the ground by the winch, and the release mechanism is opened to allow the chair assembly to swing in a curved trajectory;

a plurality of support lines attached to said upper support structure;

a plurality of stabilization lines attached to said upper support structure;

a plurality of chair assemblies each attached to the lower end of a stabilization line and the lower end of a support line; and said release mechanism further comprises a swivel allowing each of said chair assemblies to rotate through 360° about an axis substantially parallel to said support line.

14. An amusement ride for raising a chair assembly from a static position at or near the ground to a height of at least ten meters and releasing the chair assembly to swing in a curved trajectory, the amusement ride comprising:

a support structure extending at least eleven meters from the ground;

said support structure having an upper support structure suspending a support line and a stabilization line, each line having a lower end;

said lower ends attached to a chair assembly having an upright seat affixed to a frame;

said frame having a maximum load capacity of four riders;

a launch tower extending upwardly from the ground and disposed from said support structure at a distance adequate to raise the chair assembly at least ten meters above the ground by a launch line routed through the launch tower and fastened to a winch;

said launch line having a release mechanism attached to the chair assembly, whereby the chair assembly is raised at least ten meters above the ground by the winch, and the release mechanism is opened to allow the chair assembly to swing in a curved trajectory;

a plurality of launch brackets each having a launch line attached to the release mechanism, whereby a plurality of chair assemblies is raised at least ten meters above the ground by a plurality of winches; and said release mechanism further comprises a swivel allowing each of said chair assemblies to rotate through 360° about an axis substantially parallel to said support line.

15. An amusement ride for raising a chair assembly from a static position at or near the ground to a height of at least ten meters and releasing the chair assembly to swing in a curved trajectory, the amusement ride comprising:

a support structure extending at least eleven meters from the ground;

said support structure having an upper support structure suspending a support line and a stabilization line, each line having a lower end;

said lower ends attached to a chair assembly having an upright seat affixed to a frame; wherein said chair assembly further comprises a plurality of chairs attached to the frame;

said frame having a maximum load capacity of four riders;

a launch tower extending upwardly from the ground and disposed from said support structure at a distance adequate to raise the chair assembly at least ten meters above the ground by a launch line routed through the launch tower and fastened to a winch;

said launch line having a release mechanism attached to the chair assembly, whereby the chair assembly is raised at least ten meters above the ground by the winch, and the release mechanism is opened to allow the chair assembly to swing in a curved trajectory; further comprising an elevated platform for rider ongress and egress;

said chair assembly further comprises a plurality of chairs attached to the frame; and said release mechanism further comprises a swivel allowing said chair assemblies to rotate through 360° about an axis substantially parallel to said support line.

* * * * *